US006941591B2

(12) United States Patent
Battiston et al.

(10) Patent No.: US 6,941,591 B2
(45) Date of Patent: Sep. 13, 2005

(54) THREE-IN-ONE COMMODE WITH WASTE DIVERTING CAPABILITY

(75) Inventors: Joseph Battiston, Sutherland, VA (US); David Battiston, Richmond, VA (US)

(73) Assignee: Tubular Fabricators Industry, Petersburg, VA (US)

( * ) Notice: Subject to any disclaimer, the term of this patent is extended or adjusted under 35 U.S.C. 154(b) by 47 days.

(21) Appl. No.: 10/278,137

(22) Filed: Oct. 22, 2002

(65) Prior Publication Data

US 2005/0076426 A1 Apr. 14, 2005

Related U.S. Application Data

(60) Provisional application No. 60/337,574, filed on Oct. 22, 2001.

(51) Int. Cl.[7] ..... A47K 11/04

(52) U.S. Cl. ..... 4/483; 4/300.3; 4/DIG. 5

(58) Field of Search ..... 4/460, 465, 478, 4/480, 483, 667, 254, DIG. 5, 300.3, 420.3, 445, 446; 297/411.3, DIG. 10

(56) References Cited

U.S. PATENT DOCUMENTS

| | | | | | |
|---|---|---|---|---|---|
| 3,854,773 | A | * | 12/1974 | Thomas | 297/411.3 |
| 4,287,619 | A | * | 9/1981 | Brewer et al. | 4/483 |
| 4,587,678 | A | * | 5/1986 | Love et al. | 4/667 |
| 4,823,412 | A | * | 4/1989 | Spiegel | 4/483 |
| 4,888,833 | A | * | 12/1989 | Garcia et al. | 4/480 |
| 5,068,927 | A | * | 12/1991 | Massaro | 4/480 |
| 5,163,188 | A | * | 11/1992 | Munroe | 4/483 |
| 5,526,537 | A | * | 6/1996 | Conrad | 4/483 |
| 6,006,369 | A | * | 12/1999 | Bly | 4/236 |

FOREIGN PATENT DOCUMENTS

| | | | | | |
|---|---|---|---|---|---|
| GB | 2237735 | A | * | 5/1991 | A47C/3/14 |

* cited by examiner

*Primary Examiner*—Tuan Nguyen
(74) *Attorney, Agent, or Firm*—Klauber & Jackson LLC

(57) ABSTRACT

A three-in-one commode with waste diverting capability is disclosed for use by elderly or infirm people wherein the commode can interface with both a standard and an elongated toilet, yet provides the comfort and ease of use of an elongated size toilet seat for the users.

24 Claims, 12 Drawing Sheets

THREE-IN-ONE COMMODE WITH WASTE DIVERTING CAPABILITY

This application claims priority from provisional application 60/337,574, filed Oct. 22, 2001.

BACKGROUND OF THE INVENTION

1. Field of the Invention

The present invention relates to commodes and toilets for ill and/or elderly people.

2. Description of the Related Art

In the field of toilets, there are two types of seats, standard and elongated. While the exact dimensions can sometimes vary, a standard toilet, is a toilet having a generally round (or egg shaped) opening toilet, and which is installed in most homes and offices, etc. A standard toilet (sometimes referred to as a regular toilet), or also referred to as a household toilet (which is not the most accurate description as standard toilets are available in offices, commercial buildings, etc.).

Standard toilet bowls are adapted to use standard toilet seats. The standard toilet seat has an opening commensurate with the opening of a standard toilet bowl.

On the other hand, an elongated toilet is generally defined as any toilet other than a standard toilet (except for a pediatric size) which has a larger opening than the standard toilet. Elongated toilet seats are adapted to fit on elongated toilets, which are generally more oblong, elliptical, and/or rectangular in shape (generally with rounded edges), and has a larger open area than the more circular standard toilet.

Elongated toilets (and elongated toilet seats) are desirable for excessively obese patients, as well as people with certain medical conditions (swelling) where the standard toilet seat is too small.

Commodes are often used in hospitals, hospices, and are used in the homes by ill and elderly people because they provide support that is not available from a stationary toilet. Specifically, a commode generally comprises at least a front cross bar, a rear cross bar, and two side cross bars. A toilet seat usually is arranged so that at least two sides rest on either the front and rear crossbar, or the two side cross bars, to stabilize the seat.

A commode has a pan having an upper portion and a lower portion, the pan being arranged underneath the toilet seat. While the pan could have a solid bottom, most commodes have an opening in the bottom of the pan. The entire commode itself is arranged to be placed over a toilet, so that waste will be discharged from the opening in the bottom of the pan directly into the toilet. This permits a more hygienic design than a closed pan, which would have to be removed and discharged.

The upper portion of the pan has a generally arcuate surface extending downwardly from the upper portion of the pan to a generally circular bottom. Although the generally circular bottom is preferred, other shapes, (square, substantially triangular, rectangular, etc.) could be used. However, the prior art is lacking in providing a commode adapted to specifically accommodate the larger and ill patients.

SUMMARY OF THE INVENTION

Three-In-One Commode

The present invention provides a three-in-one commode, the three features being a commode which has drop arms, an elongated toilet seat and a pan having an integrally formed or attached a splash guard adapted so that the commode can be positioned over a standard toilet, yet provide a user with the comfort of an elongated toilet. The pan, which communicates with the elongated toilet seat at an upper portion, is tapered downwardly to fit over or in a standard toilet bowl. The commode comprises a front cross bar assembly, a rear cross bar assembly, and two drop arms which are pivotally connected, slidably connected, or attachable/detachable from at least one of the front or rear cross bars so as to provide adjustable arm rests and provide support while getting on or off the commode, an elongated toilet seat arranged on top at least two opposing crossbars, and a pan arranged below the elongated toilet seat, said pan having an elongated upper portion which is tapered downwardly to a lower portion having an opening on the bottom, so that the lower portion fits over a standard toilet bowl, yet the commode provides the user with the comfort of an elongated toilet.

The arms rails provide an additional source of stability for a user to hold on while getting on or off the commode. There are often patients with mobility and balance problems, such as stroke patients, patients taking medications that can cause drowsiness, patients in wheelchairs and/or have multiple sclerosis and their need to use their arms to pull themselves onto or off of the commode because of weakness in their legs, just to name a few.

The three-in-one commode may optionally include side cross bars, the side cross bars are attached to portions of the front and rear cross bars by any of the securing means comprising: clamping, welding, bolting, riveting, bonding, spring loaded pins, etc.

Optionally, in an embodiment, the front cross bar assembly and the rear cross bar assembly have lower stabilizer bars which are formed so that a least a center portion of each lower stabilizer bar is in contact with the center portion of the other stabilizer bar, and can be clamped, welded, bolted, nailed, screwed, snapped, riveted, glued, or even sintered together. For purposes of illustration and not limitation, the rear stabilizer bar can be generally U-shaped, C-shaped, V-shaped, or L-shaped, and the front stabilizer can be shaped the same way, except that its orientation is changed so that the stabilizer bars will contact each other for at least a portion of their length. Generally, the rear stabilizer bar is formed so that the commode could be pushed from the front of a stationary toilet so that it fits over the stationary toilet, wherein the portion where the stabilizer bars contact each other serve an alignment function.

Optionally, the three-in-one commode could have a closed pan, or come with a bucket that either attaches to the pan, or is positioned directly under the pan.

Optionally, in another aspect of the invention, a backrest may be attached to, extend from, or form part of the rear cross bar assembly.

The three-in-one commode permits heavy-duty support for ill and/or elderly people having problems with balance, walking, etc., by supporting the user via the drop arms arranged on the sides. In one embodiment, the three-in-one commode can support as much as 600 pounds in weight. In another embodiment, the three-in-one commode can support more than 1000 pounds of weight.

Optionally, a lower portion of the elongated toilet seat may have side rails by which the pan is slidably installed and/or removed from underneath the elongated toilet seat.

Optionally, the rim of the pan may be arranged over at least upper portions of the front and rear cross bars.

The elongated toilet seat can be attached by a hinge mechanism so as to be pivotally moved in a first position directly over the pan, and in a second position perpendicular to the upper surface of the pan, permitting removal for cleaning, etc.

Optionally, while the three-in-one commode provides the advantage of providing the comfort of an elongated toilet with the practicality of being adapted for use over a standard toilet seat, in one preferred embodiment, the commode could be adapted to be positioned over an elongated and/or non-standard toilet bowl.

Optionally, the height of the commode can be adjustable by having an upper portion of the front cross bar and rear cross bar being arranged so as to be telescopically arranged in tubular lower portions, and a pin or key can be used to adjust the height defined by a series of holes in both the upper portion and lower portions of the cross bars, the holes which need to be aligned so that the pins or keys can penetrate the aligned holes.

Optionally, the height of the arm rests can be adjustable by having the upper portions of the side cross bars being telescopically arranged in tubular lower portions of the side cross bars, and a pin or key can be used to adjust the height defined by a series of holes in both the upper portion and lower portion, the holes which need to be aligned so that the pins or keys can penetrate the aligned holes.

Optionally, a toilet paper roll 121 can be attached anywhere on the frame of the three-in-one commode, meaning anywhere on any of the front, rear, and/or side cross bars.

Optionally, the three-in-one commode can have non-skid feet attached at the bottom, to decrease the possibility that a person with mobility problems is injured by the commode sliding while a person is mounting or dismounting the same.

The downward tapering of the pan is optionally tapered downward and toward the back, allowing for a an improved splash guard function as the liquid flowing into the pan will tend to contact the upper portion of the pan in the front and roll downward toward the opening. This design prevents the ricochet of fluids off the sidewalls of the pan, keeping the user dry and providing a more hygienic commode than heretofore known in the prior art.

For purposes of illustration and not limitation, the angle in the front is, in one embodiment, approximately 45 degrees, as a lower angle tends to make the front portion too flat, which will increase the possibility of ricochet, and a higher angle than 45 degrees may also contribute to increased splatter. However, this 45 degree angle is intended for only one particular aspect of the invention, and a person of ordinary skill in the art should understand that the presently claimed invention is not limited to a 45 degree angle in the front of the pan, and can be any angle, so long as there is a downward tapering so that the elongated opening fits into a standard toilet.

Optionally, in another aspect of the present invention, there can be two pan support bars connecting the front cross bar to the rear cross bar along the top of each cross bar, the pan support bars being spaced apart sufficiently so that the pan can be placed therebetween, and a rim along the edge of the pan can rest stably on the pan support bars.

Waste Diverting Toilet Seat

The present invention includes a waste diverting toilet seat, wherein the seat and splashguard comprise a single unit. The waste diverting seat can be integrally formed from a single mold, or the seat and splashguard can be joined by any known method, such as adhesive, sintering, fasteners, bolts, screws, pins, nails, or even temporary connections such as a Velcro®-type fastener. In addition, the splashguard may snap into the toilet seat, which is adapted to receive the splashguard. Alternatively, the splashguard or toilet could have flanged surfaces adapted for slidable installation and removal along rails formed in a portion of the toilet seat. For example the thickness of the seat could be reduced at a front portion so the flanged front of the splashguard fits in rails formed on a lower portion of the seat.

The portion of the splashguard that fits into the toilet seat may optimally have a thickness so as to fill in the reduced thickness of the front portion of the seat so that the thickness of the seat that rests upon the upper surface of a toilet bowl is approximately equal.

Alternatively, the waste diverting seat may have the front portion of the toilet seat (that receives or is attached to the splashguard) oriented at a slight incline to add in the diversion of the waste down the splashguard and toward the back of the lower portion of a toilet bowl, where the opening to the sewage pipe is situated.

The waste diverting seat may also have a splashguard with a spiral inner configuration to aid in centrifugal action of the waste as it is diverted down into the toilet bowl.

The waste diverting toilet seat can have a standard opening, or elongated opening, these sizes being known by persons of ordinary skill in the art.

The waste diverting toilet seat may also have a provide an elongated opening for a toilet bowl having a standard opening (The terms for elongated and standard being known to persons of ordinary skill in the art). This particular embodiment would extended beyond the front portion of a standard toilet bowl, and the splashguard formed in the waste diverting toilet seat would be tapered back toward the standard toilet opening because it would be arranged in a channel, groove, or void in the lower portion of the toilet seat, preferably toward the front. The thickness of the seat should be chosen to provide the clearance necessary for a person to sit on an elongated seat, and if they were sitting toward the front of the seat, not physically contact the front of the toilet seat. This could be a approximately several inches thick, optionally but in no way limited to at least three inches. Of course, an approximate two inch thick seat, or any number (such as four inches, six inches eight inches, etc.) would be within the spirit and scope of the invention. The thicker toilet seat would assist ill/elderly people because they would not have to sit as low as they would on a standard toilet seat, yet provides the comfort of an elongated opening with a splashguard so that the waste diverting seat can be arranged on a standard size opening toilet bowl.

The waste diverting seat could be used in homes, hospitals, hospices, doctors offices, offices, public restrooms, or anywhere that accommodates a toilet.

DETAILED DESCRIPTION OF THE PREFERRED EMBODIMENTS

Figure 1:
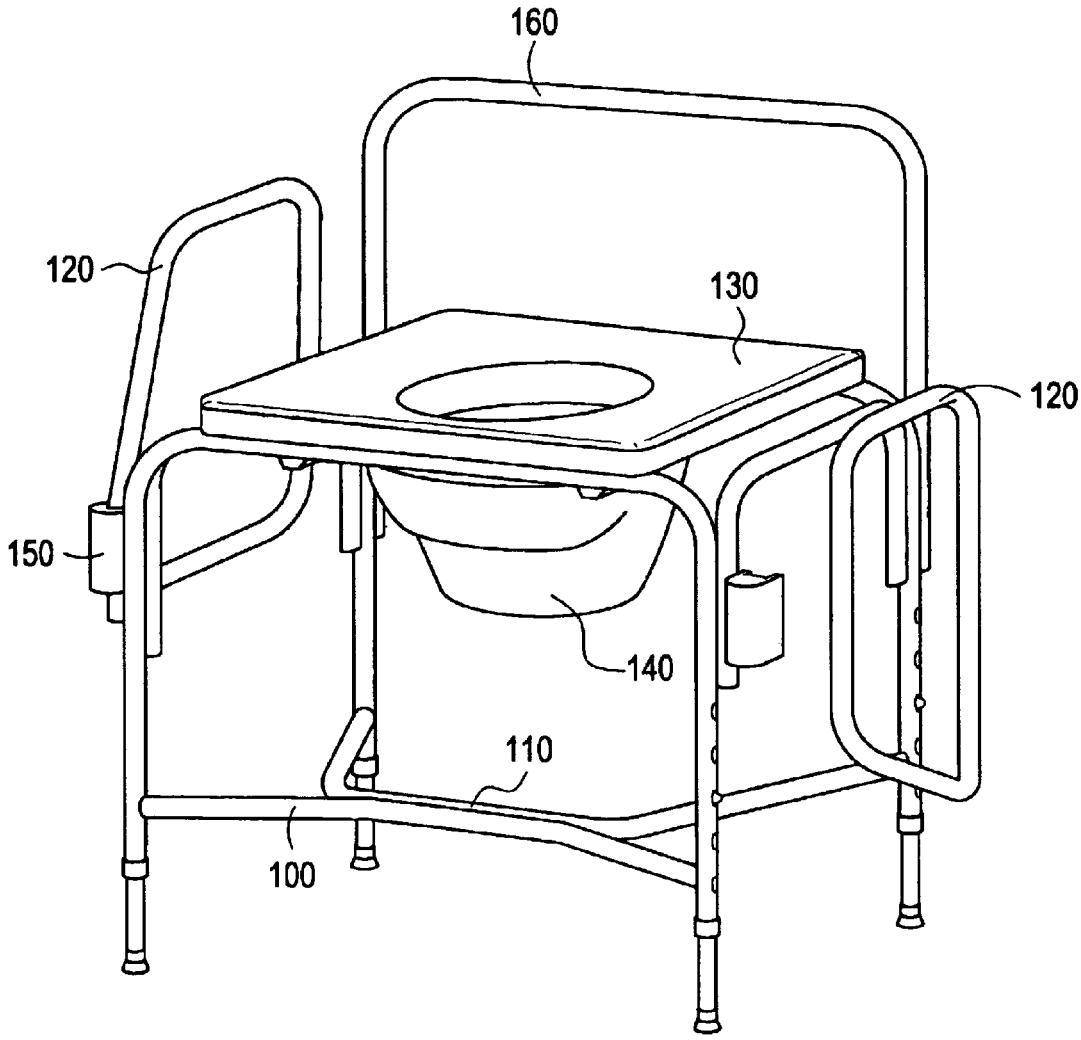
FIG. 1 is a perspective view of one embodiment the three-in-one commode according to the present invention.

FIG. 1 illustrates an embodiment of a three-in-one commode according to the present invention. While this embodiment is a heavy-duty commode, which permits weight capacities up to 600 lbs, the invention is not limited to this weight. For example, the same basic structure can be used to permit capacities of 1000 lbs. or more, or it could also be made to support a standard weight.

Normally, for reasons of safety, it is preferred that the commode be able to provide a minimum of 300 lbs. of support. Given the possibility that the commode can be used in both care facilities as well as at home, there is a possibility that while the typical user weighs far less than 300 lbs., but that another person who is considerably heavier could use the commode without risk of injury.

FIG. 1 shows a frame comprising a front cross bar assembly 100, a rear cross bar assembly 110, drop arms 120, a stationary seat 130 (this seat could be removable, pivotable or slidably detachable from the frame) and a pan 140.

The arms 120 are shown where the left arm is in an upright locked positioned, but the right arm is in an unlocked positioned. There can be instances where locking and using only one side is preferable, for example, when a person suffering from paralysis on one side needs the assistance of a care-taker to get on and off the seat. By keeping one rail down, this could assist the caretaker in holding on and providing support to the patient's weak side during the seating and dismount from the commode.

The arms, also referred to as "drop arms" could be pivotable, slidable, and snappable, include fasteners, which can be fastened and or unfastened by the user. The arms may have a series of holes therein whereby a pin and or bolt is arranged, which may or may not be spring loaded, can be used to adjust and or lock the arm into position. In the depicted embodiment in FIG. 1, clamps 150 are used. The clamps could be tensioned to remain closed but have a space in a center portion just slightly smaller than the width of each of the arms, so that the arm is pushed into the clamp and remains held in place by the bias in the closed position. Alternatively, there could be spring-loaded clips, pins, etc, which are pushed into the clamps after the arm is positioned in place. The arms could pivot from a lower position horizontally, vertically, or a combination of the two, depending on the particular shape of the arms, the type of clamp or fastener.

The backrest 160, may telescopically extend out of the rear cross bar, or it could be attached by any known method. The backrest is not required, and could either be adjustable, or permanently welded into position, if present. The backrest in the depicted embodiment has a U-shape, but the artisan understand that any shape (e.g. V-Shape, C-shaped, L-shaped, A-shaped, tapered, round, oval, triangular, polygonal) could be used.

Figure 2:
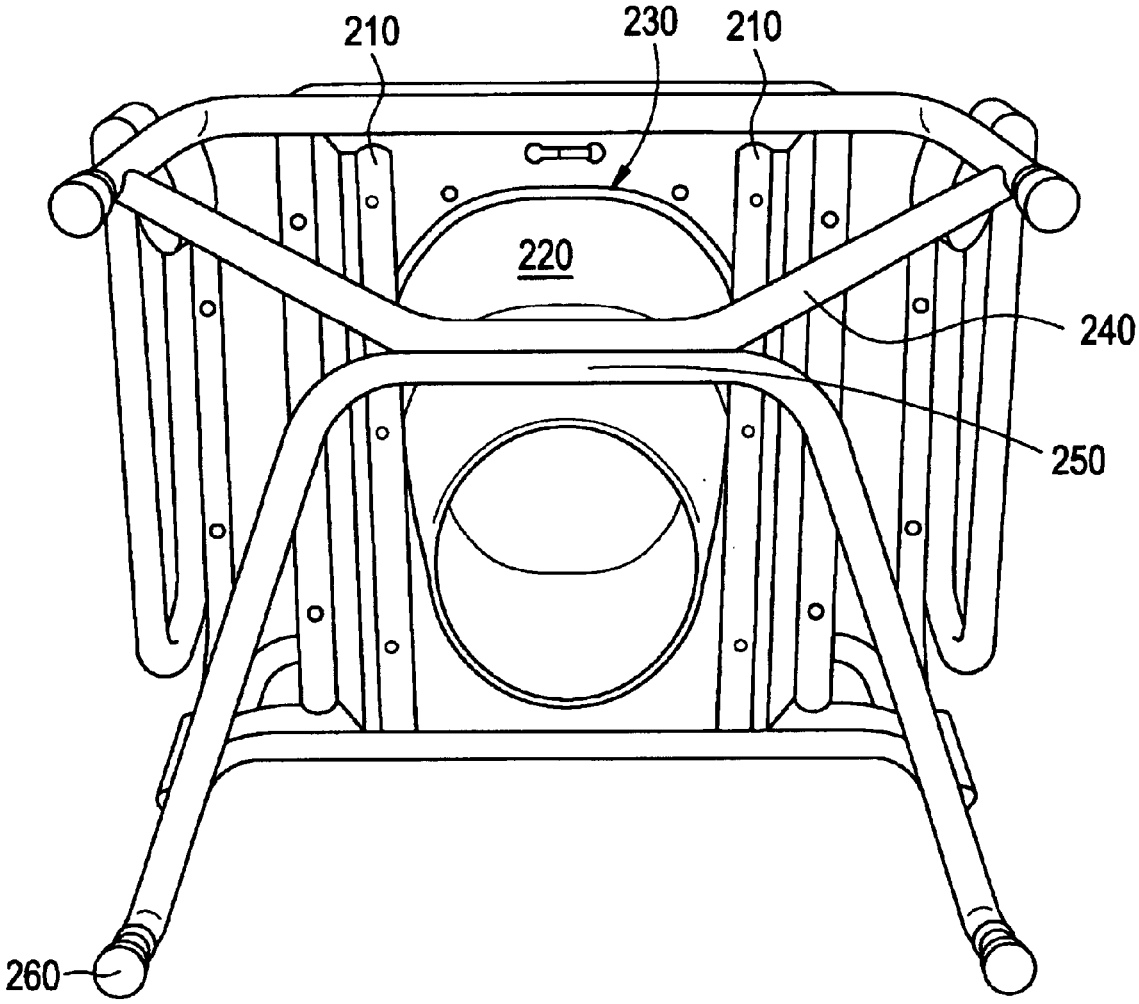
FIG. 2. is bottom view of the embodiment shown in FIG. 1, showing the arrangement of the pan, which slides along rails underneath a stationary seat.

As shown in FIG. 2, the seat 130 has two side rails 210 which are spaced apart at a predetermined length to permit the pan 220, having a rim 230, slide in and out of the rails for cleaning and/or storage.

The pan 220 has an opening on the bottom to permit the commode to be arranged over a standard toilet. Alternatively, the commode could be positioned over a bucket, or a bucket could be attached to the pan but providing, for example, a flanged rim on the bottom of the pan, so that a bucket could be slide thereon.

Figure 3:
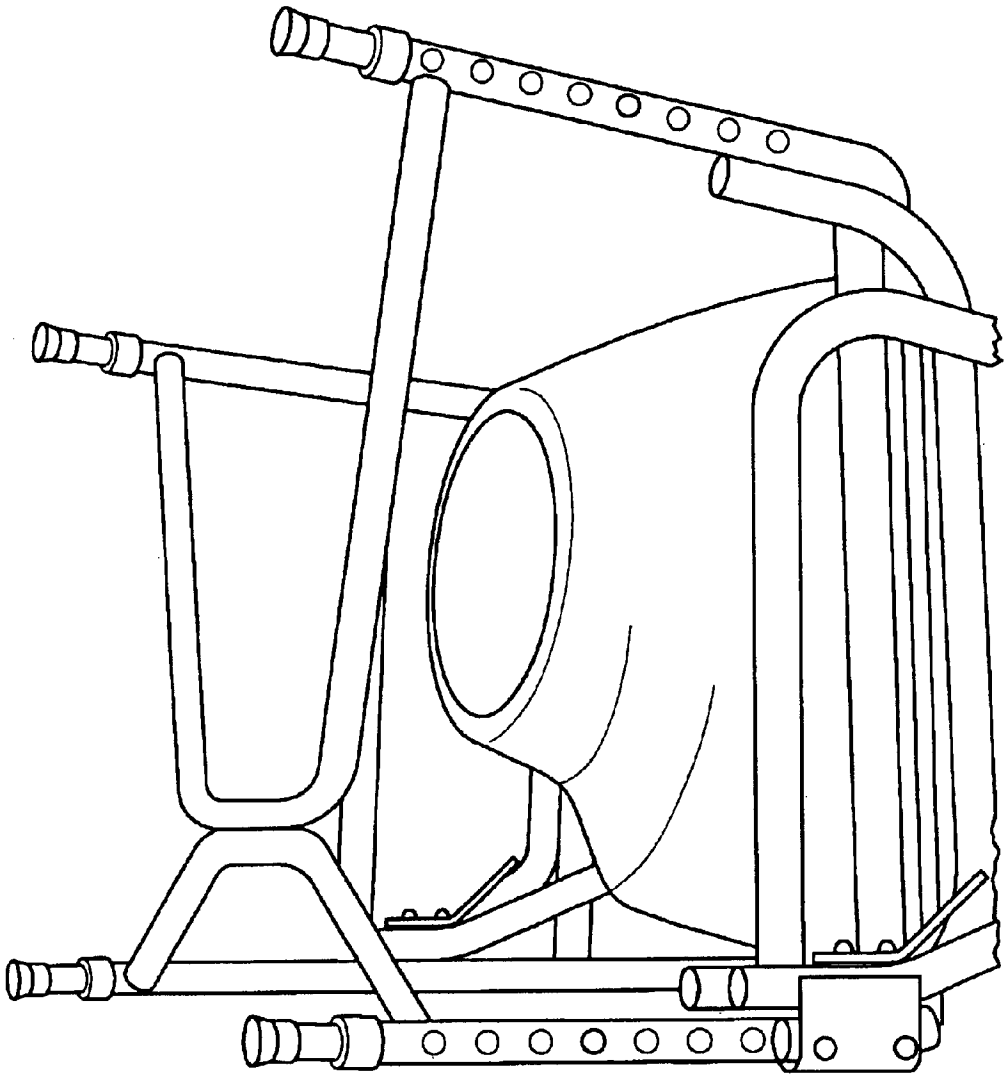
FIG. 3 a bottom view of the embodiment shown in FIG. 2, rotated by 90 degrees to illustrate the arrangement of the rear cross bar and the rear stabilizer bar.
Figure 4:
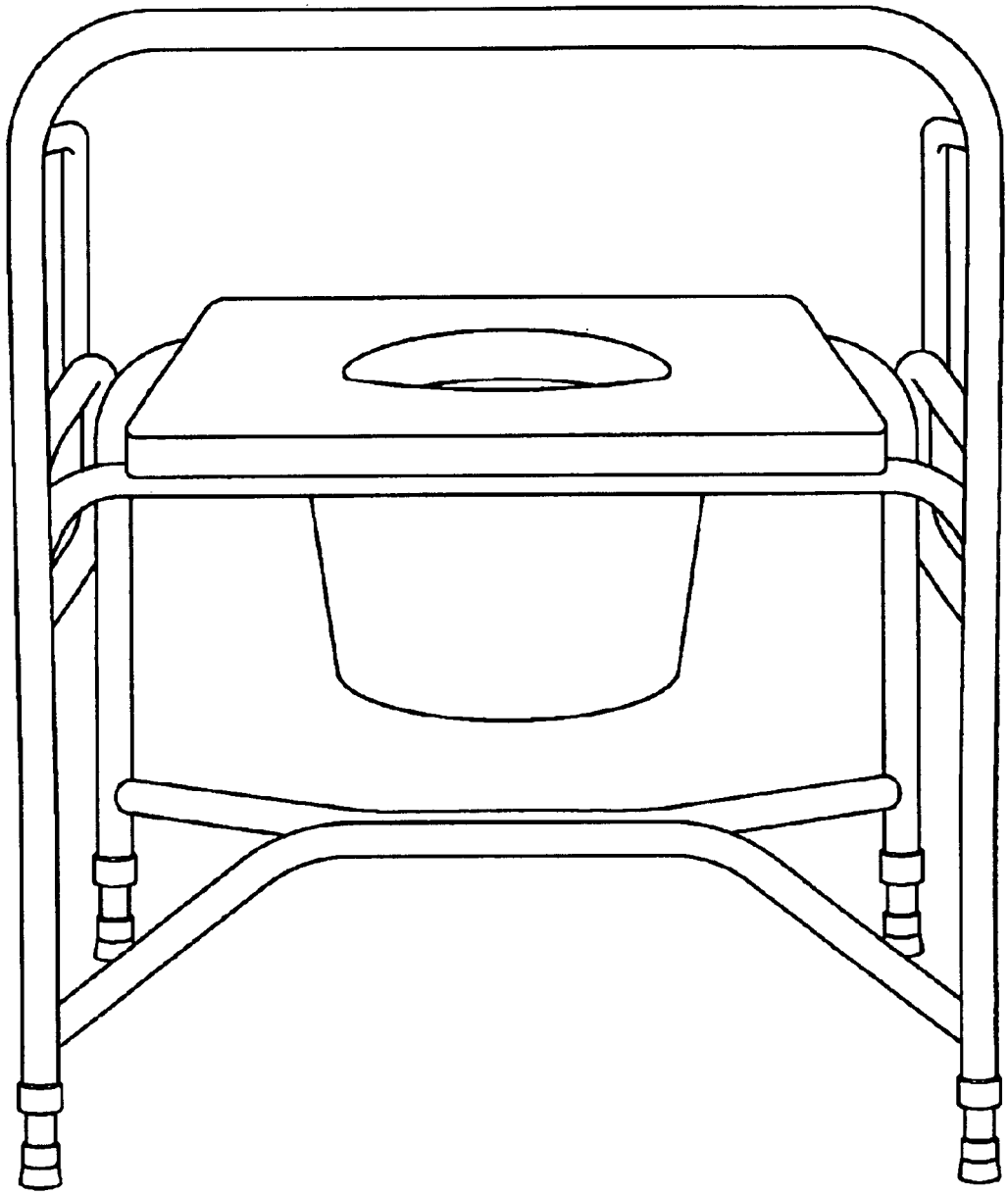
FIG. 4 is a rear view of the first embodiment.

FIG. 2 also shows the front stabilizer bar 240 and the rear stabilizer bar 250. As shown in the figure, the front stabilizer bar attaches to the front cross bar, and the rear stabilizer bar attaches to the rear cross bar. Both stabilizer bars are formed so that at least a portion of the stabilizer bars is in contact with each other to provide the additional stability. FIGS. 3 and 4 also show different views of the stabilizer bars.

In the depicted embodiment, the stabilizer bars are welded. However, they could be epoxied, sintered clamped, riveted, bolted, clipped together by retaining pins, etc. Also, there does not have to be literal contact between the stabilizer bars, although this is the preferred embodiment. In other words there could a clamp which has center portion that is wedged between the stabilizer bars and the when the clamp is closed, the stabilizer bars are not in literal contact with each other but are in contact with the clamp (or other fastener).

It is to be understood that the particular bending of the stabilizer bars is not the only way by which they can be formed so as to be joined, clamped, clipped, glued or welded together. While the bars can be joined according to predetermined needs for stability, the particular arrangement shown in FIG. 2 illustrates that the front stabilizer bar 240 does not have as pronounced of a bend as the rear stabilizer bar.

This forming of the stabilizer bars can be made so as to position the opening of the pan directly over a standard towel bowl, where the rear bar is has a more pronounced bend so that the rear stabilizer bar fits around the base of a standard toilet bowl, at such a positioned that when the stabilizer bar is close to contact with the standard toilet, the opening of the pan is centered over the opening of the standard toilet bowl, preferably over the portion where having the water remains when a toilet is ready for flushing.

The pan itself has an elongated upper portion comprising a splashguard that tapers down to the bottom opening. This permits the commode to have an elongated toilet seat with an elongated opening, but allows for easy usability with a standard toilet bowl. Of course, the commode could also be positioned over an elongated toilet bowl, but the advantage lies in that many homes, hospitals, hospices, health care facilities and offices have standard size toilet bowls.

Figure 5:
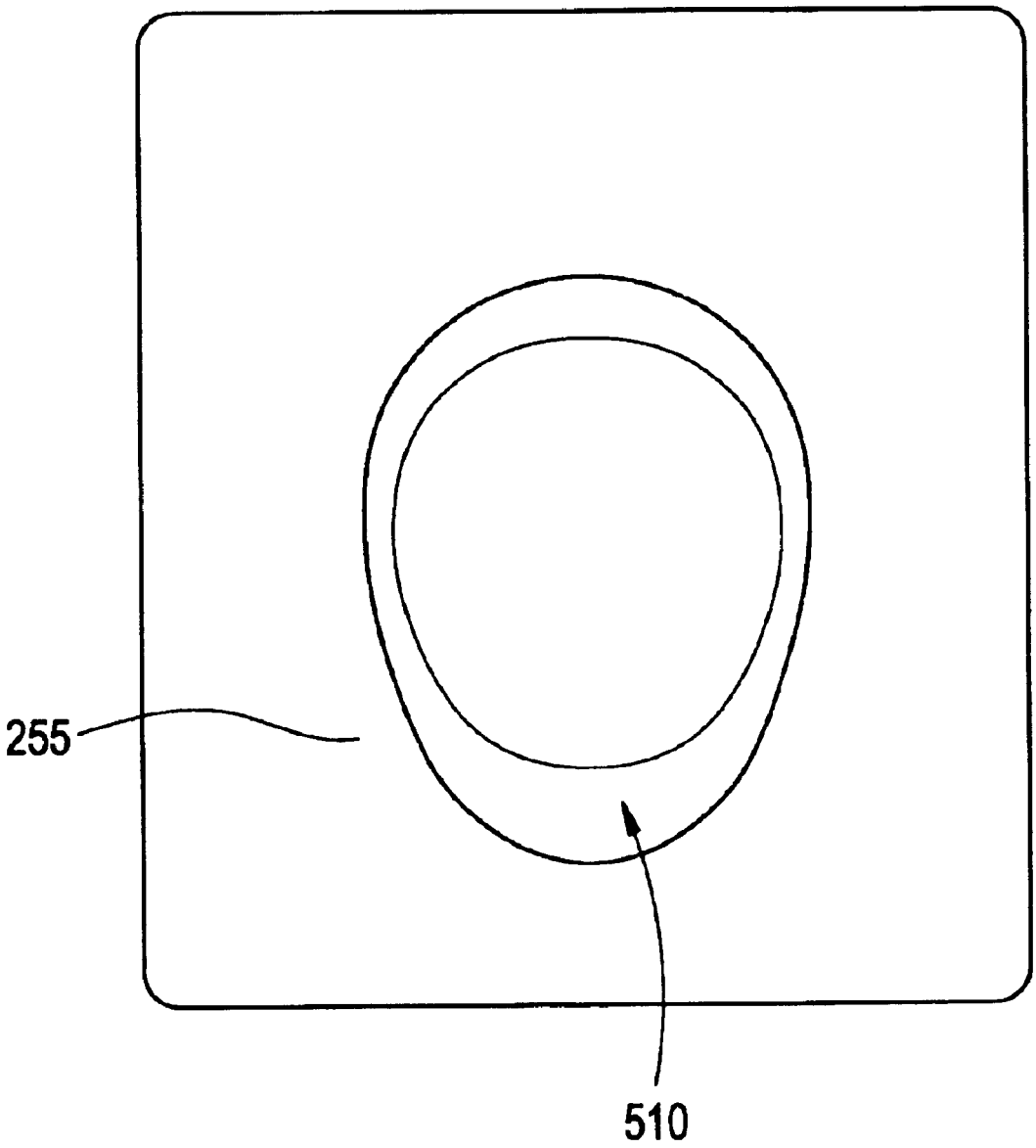
FIG. 5 is a plan view of the first embodiment, illustrating the view of the tapered pan, which includes a splashguard integrally formed therein.
Figure 6:
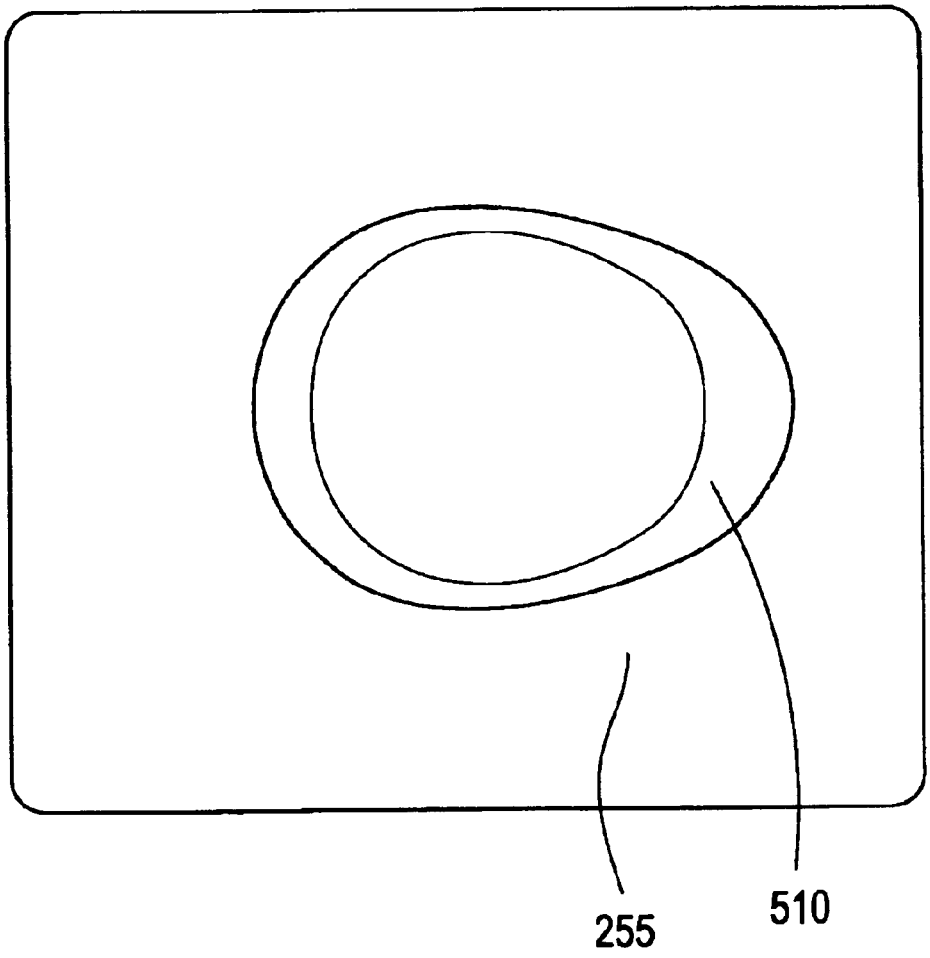
FIG. 6 is the plan view of FIG. 5 rotated by 90 degrees.

The splashguard portion 510 of the pan 255 is shown in an overhead view in FIG. 5 and FIG. 6. In addition, FIG. 7, which is a plan view of the pan shown in FIG. 2, shows how the splash guard is formed so that fluids would flow back and down toward the opening of the pan. The splash guard provides a much more hygienic commode than previously known, and allows for the use of an elongated toilet seat having an elongated opening, which via the structure of the splash guard, is formed for use with a standard toilet bowl.

Optionally, the interior of the splashguard and the pan could be spirally formed to cause the fluid to centrifugually travel a spiral path downward prior to exiting the pan. This improvement could reduce the splashing upward if the angle of exit is something other than substantially perpendicular to the water in the toilet bowl. Also, the spirals could be designed for counter-clockwise and clockwise flow, to facilitate flushing in both areas above and below the equator, because in these geographical areas the orientation of the rotation of drainage is different.

FIG. 2 also shows that the commode has feet 260, which are optional. Preferably, the feet are made of a non-skid material to reduce the possibility of the commode sliding while a user is getting on or off.

Figure 7:
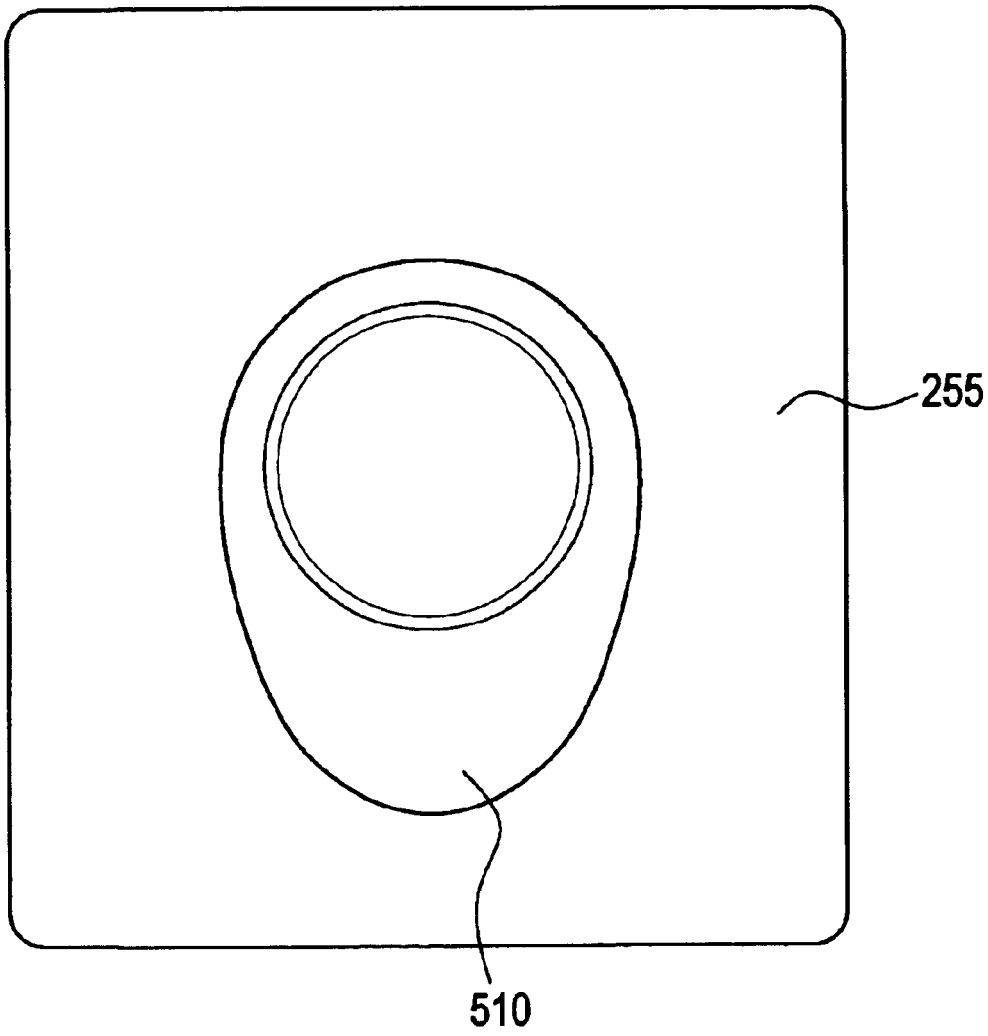
FIG. 7 is a plan view illustrating how an elongated opening in the toilet seat is adapted for use over a standard toilet by tapering the pan downward from the front of the elongated opening toward the back, so that the opening of the pan fits in or over a standard toilet opening.

FIG. 7 shows a much more pronounced difference between the elongated opening of the toilet seat and the opening of the pan at the bottom where fluid is discharged. Alternatively, the pan can be adjusted to fit at several positions below the seat to allow for custom centering of the pan over a standard toilet, elongated toilet, bucket, etc.

Figure 8:
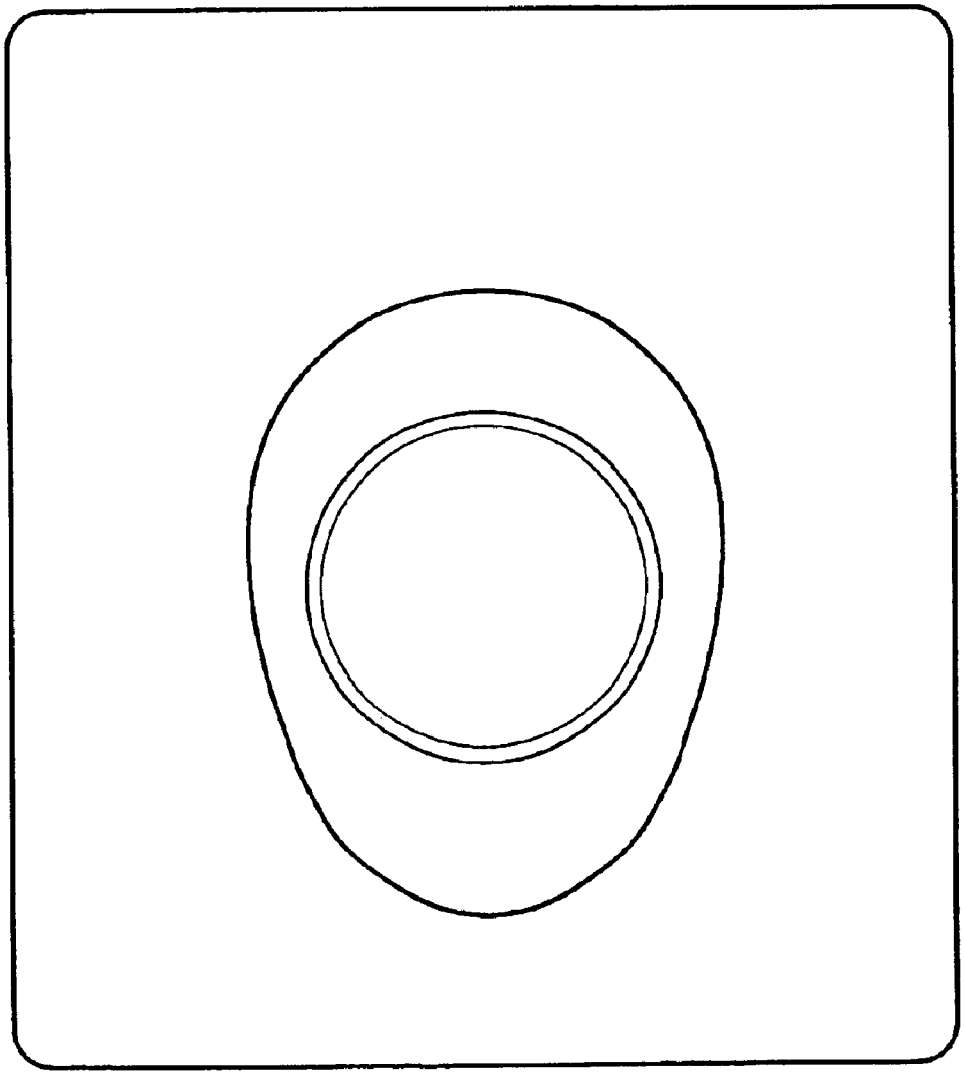
FIG. 8 shows an embodiment where the opening is more central arranged relative to the elongated opening in the toilet seat than the illustration shown in FIG. 7.

FIG. 8 shows a different position of the pan with regard to the seat than shown in FIG. 7.

Figure 9:
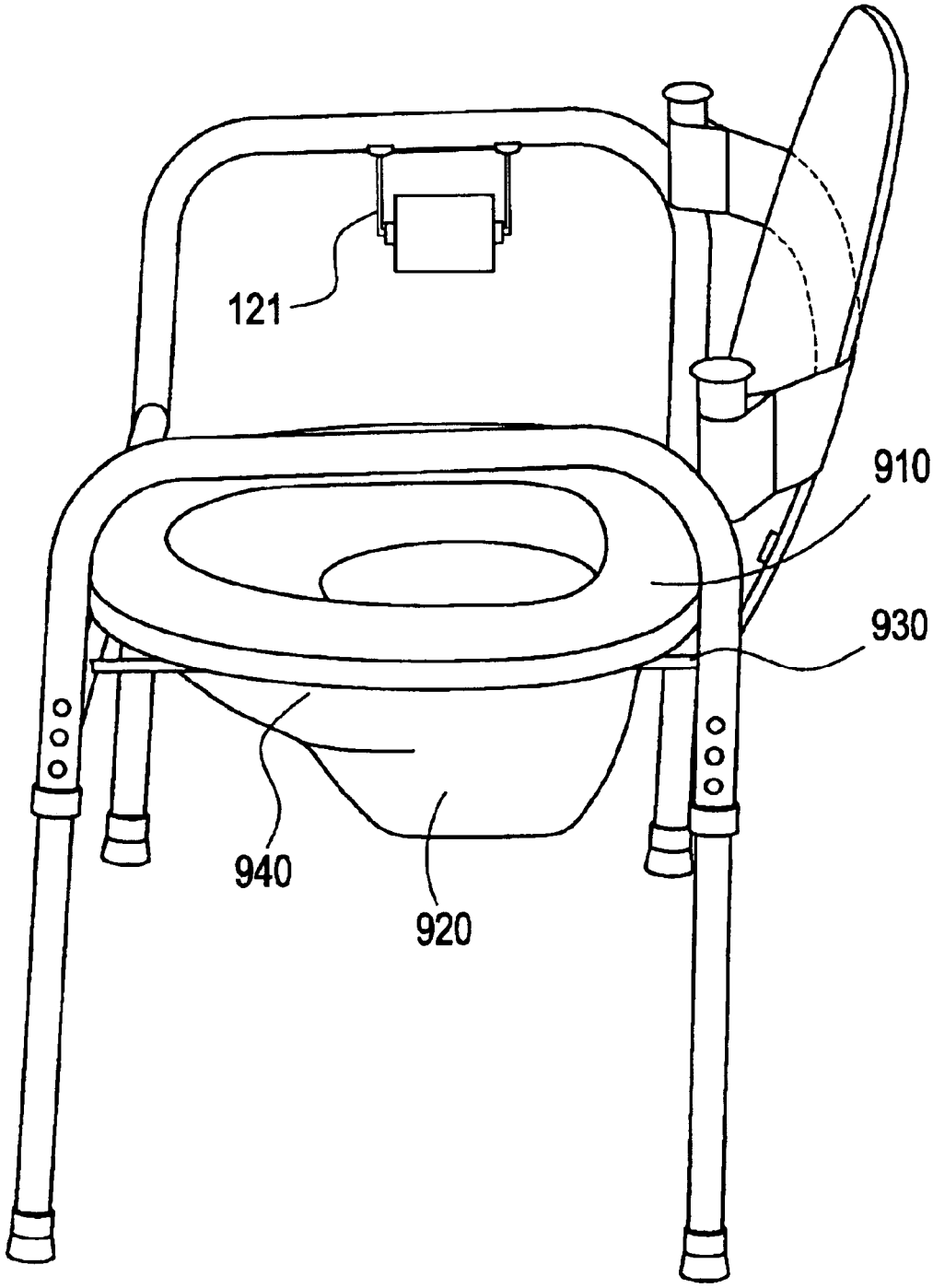
FIG. 9 illustrates another embodiment of the present invention, wherein the commode has a standard weight capacity (a person or ordinary skill in the art knows and understands what the term standard weight capacity means with regard to commodes). The toilet seat is hinged in the back so as to be flipped substantially perpendicular to the upper opening of the pan, or parallel to the upper opening of the pan when in use.

FIG. 9 shows yet another embodiment, where heavy-duty use is not required. In this three-in-one commode, an elongated toilet seat 910 is arranged to fit over the opening of the pan 920. The pan itself has flanged edges that are used to position same on pan support bars 930. In this embodiment, the pan support bars are arranged from front to back, but they could be arranged from side to side. This pan also has a splash guard portion 940 which permits more hygienic use and serves to guide the fluid to an opening suitable for positioning over the opening of a standard toilet bowl, while allowing the advantages and comfort of an elongated toilet seat and elongated opening.

Figure 10:
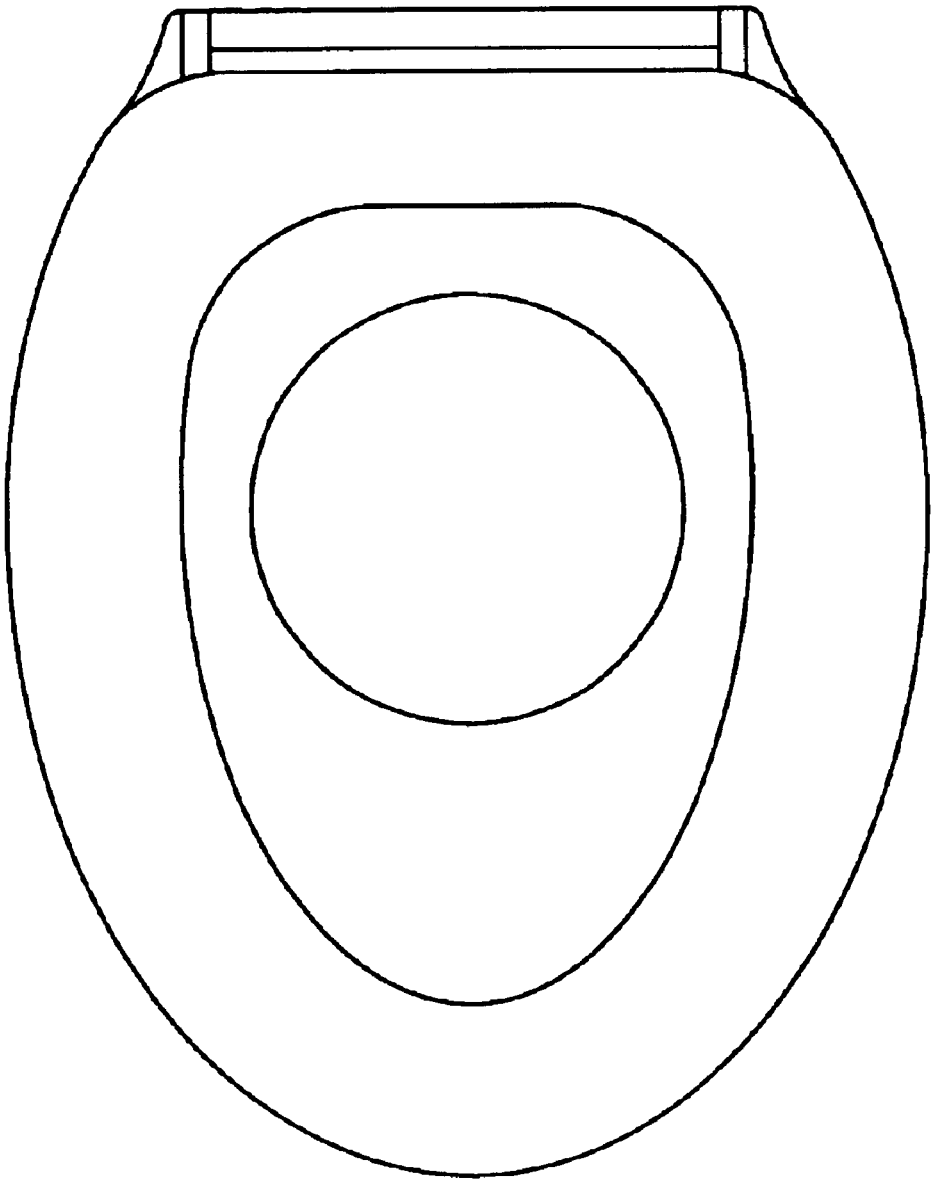
FIG. 10 is a plan view of the embodiment shown in FIG. 9, showing how the elongated opening of the pan matches the opening of the toilet seat, then tapers downward and back so as to provide a splash guard function while permitting the comfort of an elongated toilet seat in use with homes having a standard toilet bowl.

FIG. 10 is a plan view of the embodiment shown in FIG. 9. It should be noted that an artisan understands that the toilet seat can be hinged to the rear cross bar, backrest, and could even be pivotally attached to side bars or side rails.

Figure 11:
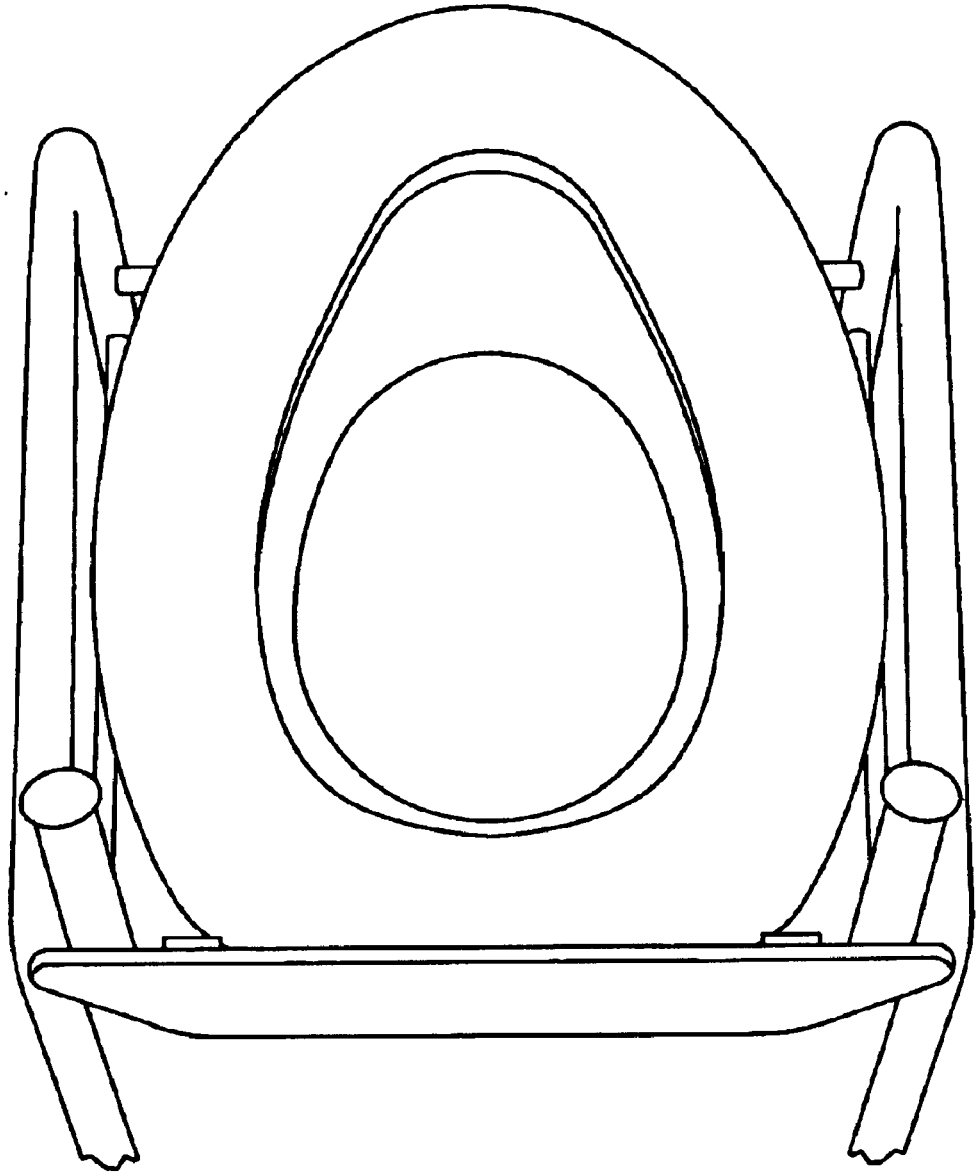
FIG. 11 illustrates how the elongated toilet seat of the three-in-one commode of the present invention can be pivoted by hinges, and wherein in lieu of a pan, the seat is attached to a splash guard without an actual pan, because the splash guard is adapted to be positioned over a standard toilet bowl.

FIG. 11 depicts how a toilet seat and splashguard can be pivotally attached to the commode. It should be understood that the splashguard is not required to be integrally formed with the pan, although such construction is preferred. For example, the splash guards could attached to the toilet seat (the toilet seat could be any of elongated, standard or pediatric) and provide direction of the fluid to a separate pan.

Figure 12:
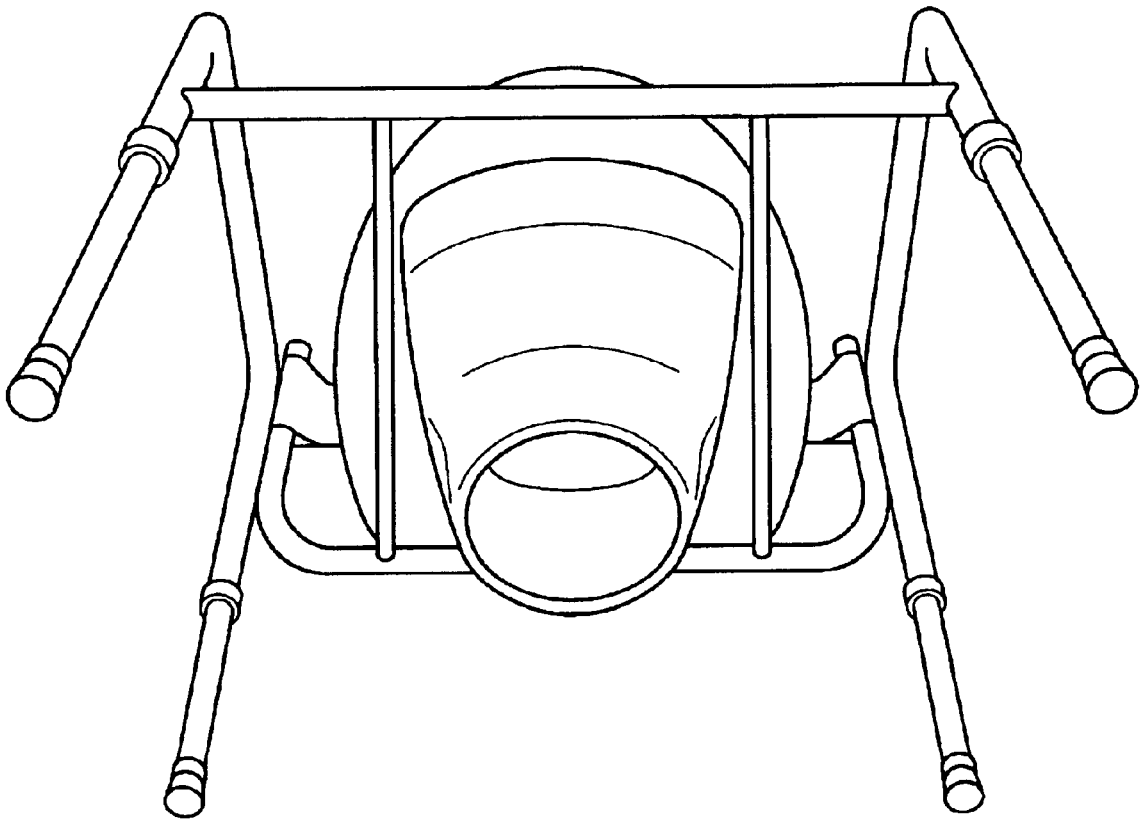
FIG. 12 illustrates a bottom view of the embodiment depicted in FIGS. 9 and 10, wherein the pan support bars can be seen providing support to the rim of the pan, which extends over portions of the support bars.

Finally, FIG. 12 is a bottom view of the embodiment depicted in FIG. 9, showing the pan support bars, in this embodiment, being attached to a horizontal support. It is by the artisan that the pan support bars can be connected to other portions of the frame (sides) etc., that would not depart from the spirit and scope of the invention.

Invention Not Limited to Depicted Embodiments

It is understood by an artisan that many modifications may be made from the embodiments depicted and/or described which does not part from the spirit and scope of the invention.

It is to be understood by persons of ordinary skill in the art that the present invention shown in the drawings and described herein are for purposes of illustration, not limitation. An artisan understands and it is well within the spirit and scope of the claimed invention that minor changes might be made to the depicted embodiments that do not depart from the invention. For example, the shapes of the crossbars do not have to be U-shaped, as they could be A-shaped, V-shaped, C-Shaped, L-shaped, square, square with rounded edges, square with chamfered edges, round, partially oval, oblong, have acute angles of intersection, have obtuse or right angles of intersection, can be a single piece, can made from multiple pieces joined together which can be pivotable, slidable, snap at least partially within one another, telescopically extended from a least a portion of each other.

Furthermore, the siderails can have polygonal shapes whereby only a handle portion extends up from two ends which are adjoined at lower ends to clamps, cross bars, side bars, legs, support bars, stabilizer bars, etc. The adjustable height can be lockable by any known method known to an artisan, including but not limited to cotter pins, flat pins, bolts, wing nuts, through-shafts, rivets, nails, bolts, etc.

It should also be understood that while the preferred material for the commode frame is metal, any substance having sufficient durability, such as plastic or wood, could be used for portions of, or all of the structure of the commode frame provided that the material can withstand the weight capacity. Further, care should be exercised so that a material is not chosen that is either too brittle that the structure could crack when under stress, or too deformable so as to bend or become misaligned, which could also be a source of injury, as persons using these type of structure are often in poor health and/or just had major surgery, and often have problems with balance and walking.

What is claimed is:

1. A three-in-one commode, comprising:

a base having left and right upper side portions and an upper central portion and lower portion, and a cut-out in said upper central portion that is adapted to receive an elongated toilet seat thereon, and said lower portion of said base being adapted for placement over a standard size toilet bowl;

at least one drop arm attached to at least one of said left and right upper side portions of the base;

an elongated toilet seat arranged above the upper central portion of the base, and a pan having a bottom opening for discharge, said pan being arranged underneath the elongated toilet seat, and said pan having an integrally formed or attached splash guard which is adapted at one end to attach to the elongated toilet seat, and wherein the splash guard, said pan being tapered downward and to the back according to a generally arcuate surface from an upper portion so as to fit over a standard sized toilet bowl and so as to divert waste downward and back towards said bottom opening for discharge.

2. The three-in-one commode according to claim 1, wherein said base comprises:

at least a front crossbar;

at least one rear crossbar connected to the at least front crossbar.

3. The three-in-one commode according to claim 2, wherein the elongated toilet seat is arranged on the front and rear crossbars.

4. The three-in-one-commode according to claim 2, wherein the at least one drop arm is pivotally connected to one of the front and rear crossbars.

5. The three-in-one commode according to claim 2, wherein the front crossbar and the rear crossbar each have a respective front and rear stabilizer bars each with respective center portions formed so that each of the center portions are in contact with each other.

6. The three-in-one commode according to claim 5, wherein the stabilizer bars are structured so as to be clamped, welded, bolted, nailed, screwed, snapped, riveted or sintered together.

7. The three-in-one commode according to claim 5, wherein the front and rear stabilizer bars are one of U-shaped, C-shaped, V-shaped, or L-shaped.

8. The three-in-one commode according to claim 5 wherein the front and rear stabilizer bars are formed to permit the commode to be aligned with a stationary toilet bowl.

9. The three-in-one commode according to claim 2, further comprising pan support bars arranged across the central portion of the base.

10. The three-in-one-commode according to claim 1, wherein the base further comprises two side crossbars that are substantially perpendicular to the front and rear crossbars.

11. The three-in-one commode according to claim 10, wherein the elongated seat is arranged on the two side crossbars.

12. The three-in-one commode according to claim 10, wherein the at least one drop arm is pivotally connected to one of the two side crossbars.

13. The three-in-one commode according to claim 10, wherein a backrest is attached to or extends from the rear crossbar.

14. The three-in-one commode according to claim 10, wherein the front, crossbar, rear crossbar, and two side crossbars have tubular telescopically arranged legs to permit adjustments in height of the elongated toilet seat.

15. The three-in-one commode according to claim 14, wherein the tubular telescopically arranged legs have a series of holes therein and one of a biased pin or key to facilitate changing the height of the elongated toilet seat and locking the new height into position.

16. The three-in-one commode according to claim 10, further comprising non-skid feet.

17. The three-in-one commode, according to claim 10, further comprising a toilet paper roll mounted on the base.

18. The three-in-one commode according to claim 10, wherein the pan is also tapered toward the back of the commode to divert liquid away from the front of the pan.

19. The three-in-one commode according to claim 18, wherein the pan has a back portion with channel grooves for deflecting fluid downward toward the bottom opening.

20. The three-in-one commode according to claim 18, wherein the pan has a series of channel grooves on an inner portion direct fluid toward the bottom opening of the pan.

21. The three-in-one commode according to claim 1, wherein the pan has a generally arcuate surface extending downward from an upper portion of the pan to a generally circular bottom.

22. The three-in-one commode according to claim 1, further comprising a bucket that is communicating with the bottom opening of the pan, so as to permit use without a stationary toilet bowl.

23. The three-in-one commode according to claim 1, wherein the pan includes a rim around an upper edge, and the base includes rails so that the pan is slidably arranged underneath the toilet seat.

24. The three-in-one commode according to claim 1, wherein the pan has a series of channel grooves on an inner portion to direct fluid toward the back of the pan.

* * * * *